US008485317B2

(12) United States Patent
Gerstenkorn et al.

(10) Patent No.: US 8,485,317 B2
(45) Date of Patent: Jul. 16, 2013

(54) LIFT INSTALLATION CONTROL SYSTEM THAT INTERFACES WITH MOBILE DEVICES

(75) Inventors: Bernhard Gerstenkorn, Ebikon (CH); Andreas Oyrer, Linz (AT); Josef Langer, St. Georgen/Gusen (AT)

(73) Assignee: Inventio AG, Hergiswil NW (CH)

( * ) Notice: Subject to any disclaimer, the term of this patent is extended or adjusted under 35 U.S.C. 154(b) by 241 days.

(21) Appl. No.: 12/863,576

(22) PCT Filed: Jan. 15, 2009

(86) PCT No.: PCT/EP2009/050410

§ 371 (c)(1), (2), (4) Date: Oct. 22, 2010

(87) PCT Pub. No.: WO2009/090207

PCT Pub. Date: Jul. 23, 2009

(65) Prior Publication Data

US 2011/0031070 A1 Feb. 10, 2011

Related U.S. Application Data

(60) Provisional application No. 61/021,695, filed on Jan. 17, 2008.

(30) Foreign Application Priority Data

Jan. 17, 2008 (EP) ..... 08100582

(51) Int. Cl.
*B66B 1/28* (2006.01)

(52) U.S. Cl.
USPC ..... 187/247; 187/396; 187/391

(58) Field of Classification Search
USPC ..... 187/247, 248, 380–388, 391–393, 187/396
See application file for complete search history.

(56) References Cited

U.S. PATENT DOCUMENTS

| | | | |
|---|---|---|---|
| 3,388,376 | A | 6/1968 | Magee |
| 4,685,536 | A | 8/1987 | Ichioka |
| 4,718,520 | A | 1/1988 | Schroder |
| 4,724,931 | A | 2/1988 | Ichioka |
| 5,010,472 | A | 4/1991 | Yoneda |
| 5,027,299 | A | 6/1991 | Uetani |
| 5,260,526 | A | 11/1993 | Sirag |
| 5,357,064 | A | 10/1994 | Boyce |

(Continued)

FOREIGN PATENT DOCUMENTS

| | | |
|---|---|---|
| DE | 650422 | 9/1937 |
| EP | 0 523 601 A1 | 1/1993 |

(Continued)

*Primary Examiner* — Anthony Salata
(74) *Attorney, Agent, or Firm* — Stroock & Stroock & Lavan LLP

(57) ABSTRACT

A method of controlling a lift installation with at least one lift car, at least one lift control and at least one mobile apparatus, and a control system for a controlling a lift installation. A reporting device near the lift installation receives at least one activation signal from a transmitting/receiving device of a mobile apparatus. The reporting device activates in response to the received activation signal. At least one network address of a recognition device of a lift control of the lift installation is transmitted from the activated reporting device to the transmitting/receiving device of the mobile apparatus.

34 Claims, 5 Drawing Sheets

U.S. PATENT DOCUMENTS

| | | | | |
|---|---|---|---|---|
| 5,389,748 | A | 2/1995 | Burke | |
| 5,412,163 | A | 5/1995 | Tsuji | |
| 5,689,094 | A | 11/1997 | Friedli | |
| 5,952,626 | A | 9/1999 | Zaharia | |
| 6,011,839 | A | 1/2000 | Friedli | |
| 6,129,182 | A | 10/2000 | Nakamura | |
| 6,425,460 | B2 | 7/2002 | Schuster | |
| 6,481,536 | B2 | 11/2002 | Pfeffer | |
| 6,868,945 | B2 * | 3/2005 | Schuster et al. | 187/380 |
| 6,986,408 | B2 * | 1/2006 | Takeuchi | 187/380 |
| 7,347,303 | B2 * | 3/2008 | Kontturi et al. | 187/380 |
| 7,353,915 | B2 * | 4/2008 | Zaharia et al. | 187/388 |
| 7,377,364 | B2 * | 5/2008 | Tyni et al. | 187/380 |
| 7,559,408 | B2 * | 7/2009 | Flynn et al. | 187/396 |
| 7,849,974 | B2 * | 12/2010 | Stanley et al. | 187/387 |
| 7,958,971 | B2 * | 6/2011 | Mangini et al. | 187/396 |
| 8,028,806 | B2 * | 10/2011 | Stanley et al. | 187/387 |
| 8,117,037 | B2 * | 2/2012 | Gazdzinski | 704/275 |
| 8,136,636 | B2 * | 3/2012 | Bahjat et al. | 187/391 |
| 8,177,031 | B2 * | 5/2012 | Flynn et al. | 187/247 |
| 2007/0025314 | A1 | 2/2007 | Gerstenkorn | |

FOREIGN PATENT DOCUMENTS

| | | | |
|---|---|---|---|
| EP | 0 631 965 | A1 | 1/1995 |
| JP | 5-15638 | | 1/1986 |
| JP | 2573723 | | 2/1992 |
| JP | 04-179685 | A | 6/1992 |
| JP | 04-266368 | | 9/1992 |
| JP | 07-330248 | | 12/1995 |
| JP | 09-175751 | A | 7/1997 |
| JP | 2628542 | B | 7/1997 |
| JP | 09-278313 | | 10/1997 |
| JP | 10-218510 | A | 8/1998 |
| JP | 11-335010 | | 12/1999 |
| JP | 2001-247266 | A | 9/2001 |

* cited by examiner

LIFT INSTALLATION CONTROL SYSTEM THAT INTERFACES WITH MOBILE DEVICES

FIELD

The invention relates to a lift installation, a method of operating such a lift installation and a method of retrofitting an existing lift installation to form such a lift installation.

BACKGROUND

In a lift installation, passengers are moved in a building. A lift installation with a recognition device for recognition of an identification code of a passenger is described in EP 0699617 A1, which is incorporated by reference herein. A recognition device is arranged in stationary position in the access region to the lift doors of the lift installation on each floor of the building. The recognition device permanently radiates an electromagnetic field. As soon as an information transmitter carried by the passenger goes into the electromagnetic field of a recognition device the information transmitter is awakened as a consequence of the electromagnetic field and transmits the data stored thereon, such as, for example, an identification code, to the recognition device. A stored, pre-defined item of destination floor information is associated with the recognised identification code and this item of destination floor information is communicated to the lift control. The lift control actuates, by this item of destination floor information, a destination call for the passenger. A lift car is moved to the floor of the passenger, the lift door is opened and the passenger boards the lift car and is moved to the destination floor.

SUMMARY OF THE INVENTION

An aspect of the present invention is the design of such a lift installation and the method of operating such a lift installation more economically. In addition, another aspect of the invention is the ability of retrofitting an existing lift installation simply and quickly to form such a lift installation.

In an embodiment, the present invention relates to a lift installation with at least one lift car, at least one lift control and at least one mobile apparatus. The lift control includes at least one recognition device and the mobile apparatus comprises at least one transmitting/receiving device. The recognition device and the transmitting/receiving device communicate with one another by wireless communication. At least one reporting device is mounted near the lift installation. The mobile apparatus includes a second transmitting/receiving device. The reporting device and the second transmitting/receiving device communicate with one another by radio network.

Thus, a passenger may communicate, using a mobile apparatus carried by him or her, not only with a recognition device of the lift control, but also with a reporting device near the lift installation. The number of recognition devices arranged in stationary position in the access region to the lift doors can thereby be reduced, which has the consequence of cost savings in the purchase cost and maintenance of the lift installation.

The recognition device and the transmitting/receiving device may communicate with one another using a local radio network. Accordingly, the reporting device and the second transmitting/receiving device may communicate with one another in a near field radio network. In one embodiment, the reporting device is a Radio Frequency Identification (RFID) transponder.

The communication is thus interference-free and secure in different radio networks and the number of recognition devices is achieved by instead using economic RFID transponders.

In an embodiment, the mobile apparatus transmits, by its second transmitting/receiving device, an activation signal to the reporting device. The activation signal is received by the reporting device. The activation signal activates the reporting device. The activated reporting device transmits a network address of the recognition device to the second transmitting/receiving device. The reporting device preferably receives the activation signal as soon as the mobile apparatus is within a predetermined reception range of the reporting device.

This allows the reporting device to be activated and supplied with electrical energy by the mobile apparatus. The reporting device thus does not need its own electrical power supply, which renders the installation and maintenance simple and economic. In addition, the reporting device thus does not permanently radiate a permanent electromagnetic field, which saves energy.

In an embodiment, the mobile apparatus transmits, by its transmitting/receiving device, an identification code to the received network address of the recognition device. The recognition device receives the identification code. The recognition device checks the received identification code. The recognition device communicates, for a positive checked identification code, a passenger recognition signal to the lift control and the recognition device transmits, for a negative checked identification code, an alarm signal. The lift control receives the passenger recognition signal. The lift control may actuate, for a received passenger recognition signal, at least one lift call. Further, the lift control may actuate at least one destination call, or the lift control may actuate at least one floor call and at least one car call, as a lift call.

Thus, a passenger can contactlessly and automatically trigger a lift call by reception of a network address of the recognition device and transmission of an identification code to the recognition device.

In an embodiment, the recognition device or the lift control assigns at least one network address to the transmitting/receiving device. The recognition device transmits at least one item of lift state information and/or at least one item of lift call information to the transmitting/receiving device, for example, the network address of the transmitting/receiving device. The transmitting/receiving device receives the item of lift state information and/or the item of lift call information. Thus, the recognition device issues the item of lift state information and/or the item of lift call information on an output device of the recognition device and/or the mobile apparatus issues the received item of lift state information and/or item of lift call information on an output device of the mobile apparatus.

Accordingly, a passenger receives lift state information and/or lift call information on an output device, which facilitates reaching a destination floor for the passenger.

In an embodiment, the output device issues a call acknowledgement as part of the lift call information. The output device may also issue travel information as part of the lift call information. The output device may also issue an arrival time of the lift car at the boarding floor and/or an arrival time of the lift car at the destination floor as part of the lift call information.

The output device may issue at least one destination floor as part of the lift call information. A destination floor is newly selectable by the mobile apparatus and/or by the recognition device. The output device can issue several possible destination floors as an item of lift information. A destination floor is selectable by the mobile apparatus and/or by the recognition device. The recognition device and/or the transmitting/receiving device communicate a newly selected or a selected destination floor as passenger confirmation signal to the lift control. The lift control receives the passenger confirmation signal and corrects the lift call in accordance with the received passenger confirmation signal.

Accordingly, the passenger can change a destination floor or can select a destination floor from a list of possible destination floors.

In an embodiment, an existing lift installation with at least one lift car and with at least one existing lift control is retrofitted to form a lift installation according to the invention in that at least one recognition device is installed in operative connection with the existing lift control. The recognition device can communicate with a transmitting/receiving device of a mobile apparatus using wireless communication. At least one reporting device is installed near the lift installation. The reporting device can communicate with at least one second transmitting/receiving device of the mobile apparatus using wireless communication.

Thus, an existing lift installation can be retrofitted quickly in simple mode and manner. For example, the RFID transponders are adhered to lift doors and are made recognisable to passengers as a reporting device.

At least one control may be installed. The control is connected by way of at least one signal line with the recognition device and the control is connected by way of at least one further signal line with the existing lift control. Accordingly, at least one passenger recognition signal is communicated to the control by the recognition device in the case of a positive checked identification code. The control communicates, for a received passenger recognition signal, at least one lift call to the existing lift control. At least one destination call may be actuated by the control as a lift call or at least one floor call and at least one car call can be actuated by the control as lift call.

Thus, the former lift control can then be retained and the control simulates a lift call for the former lift control.

In an embodiment, at least one item of lift state information and/or at least one item of lift call information may be issued on at least one output device of the recognition device.

In an embodiment, at least one network address is assigned to the transmitting/receiving device. At least one item of lift state information and/or at least one item of lift call information may be transmitted to the network address of the transmitting/receiving device by the recognition device. The item of lift state information and/or the item of lift call information may be received by the transmitting/receiving device. The received item of lift state information and/or lift call information are issued on an output device of the mobile apparatus.

Thus, even in the case of a retrofitted lift installation, a passenger receives lift state information and/or lift call information on an output device, which facilitates, for the passenger, reaching his or her destination floor.

In an embodiment, at least one destination floor is issued as part of the lift call information. A destination floor is newly selected by the mobile apparatus and/or by the recognition device. A newly selected destination floor is communicated by the recognition device and/or by the transmitting/receiving device to the control as passenger confirmation signal. Several possible destination floors can be issued as part of the lift information. A destination floor is selected by the mobile apparatus and/or by the recognition device. A selected destination floor is communicated by the recognition device and/or by the transmitting/receiving device to the control as passenger confirmation signal. The passenger confirmation signal is thus received by the control. The lift call is corrected by the control in accordance with the received passenger confirmation signal. At least one corrected lift call is communicated to the existing lift control by the control.

Accordingly, the passenger, even in the case of a retrofitted lift installation, can change a destination floor or select a destination floor from a list of possible destination floors.

In an embodiment, the invention is also directed to a computer program which is suitable for executing and realising a method of operating a lift installation in that at least one method step is performed when it is executed on at least one recognition device and/or at least one mobile apparatus and/or at least one lift control and/or at least one control. A computer readable data memory may include such a computer program.

This enables a simple and practical distribution of computer program to the different constituents of the lift installation.

BRIEF DESCRIPTION OF THE DRAWINGS

Exemplary embodiments of the invention are explained in detail by way of the figures, in which.

DETAILED DESCRIPTION OF EXEMPLARY EMBODIMENTS

Figure 1:
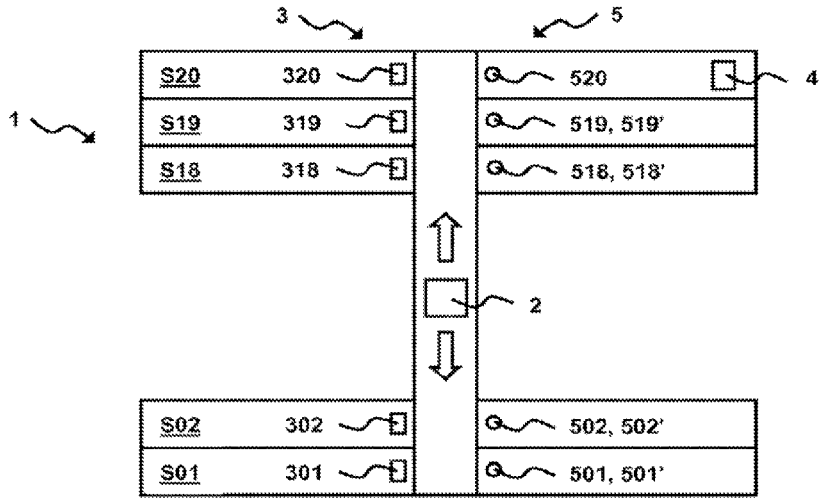
FIG. 1 shows a schematic view of a part of a lift installation according to an embodiment of the invention.
Figure 2:
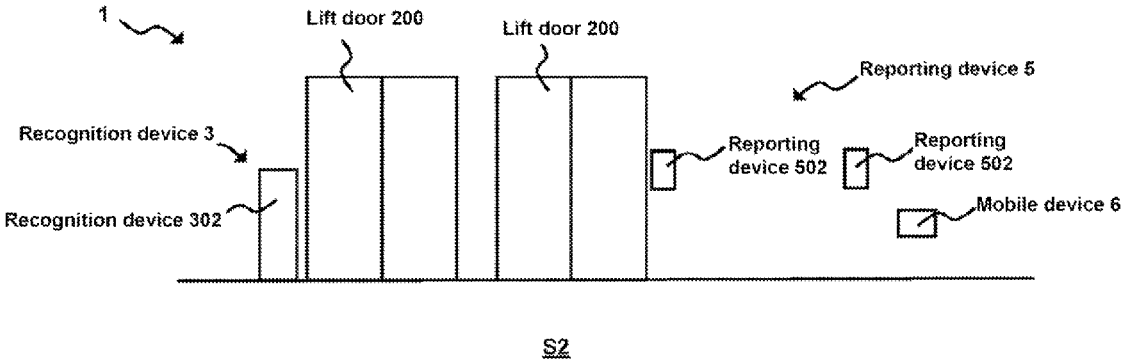
FIG. 2 shows a schematic view of a part of a floor of the lift installation according to FIG. 1.
Figure 3:
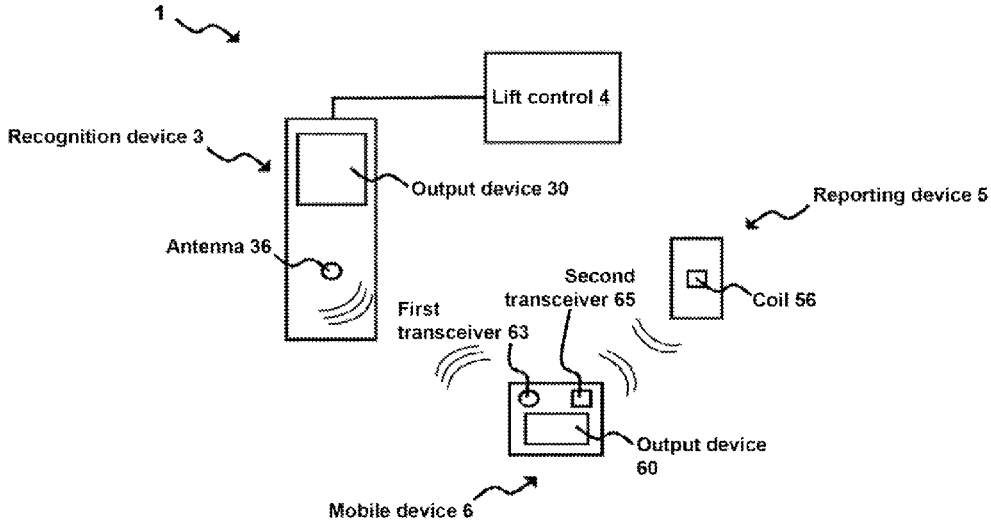
FIG. 3 shows a schematic view of a part of the lift installation with communication between a lift control and mobile apparatus according to FIGS. 1 and 2.
Figure 4:
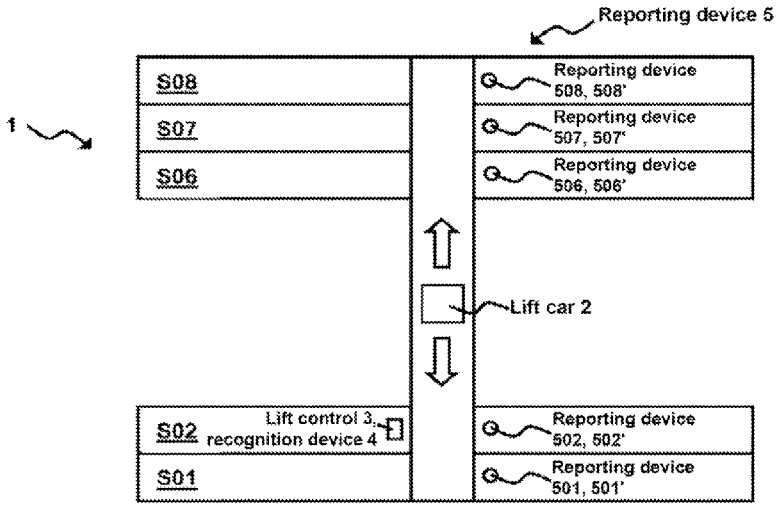
FIG. 4 shows a schematic view of a part of a lift installation according to an alternate of the invention.
Figure 5:
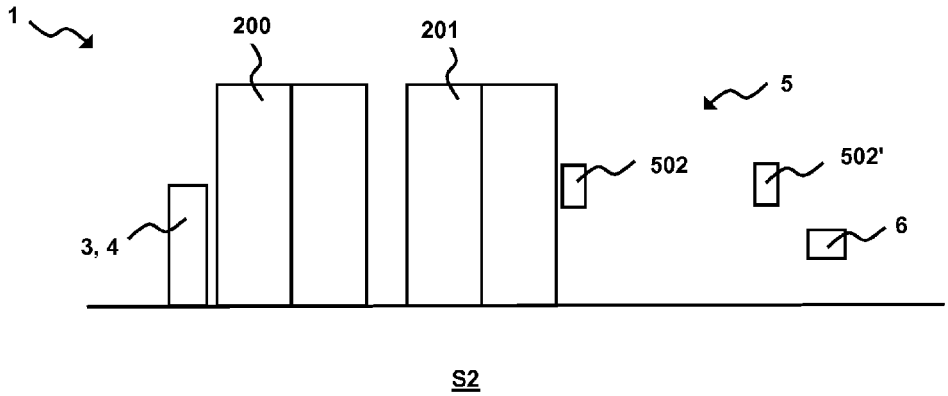
FIG. 5 shows a schematic view of a part of a floor of the lift installation according to FIG. 4.
Figure 6:
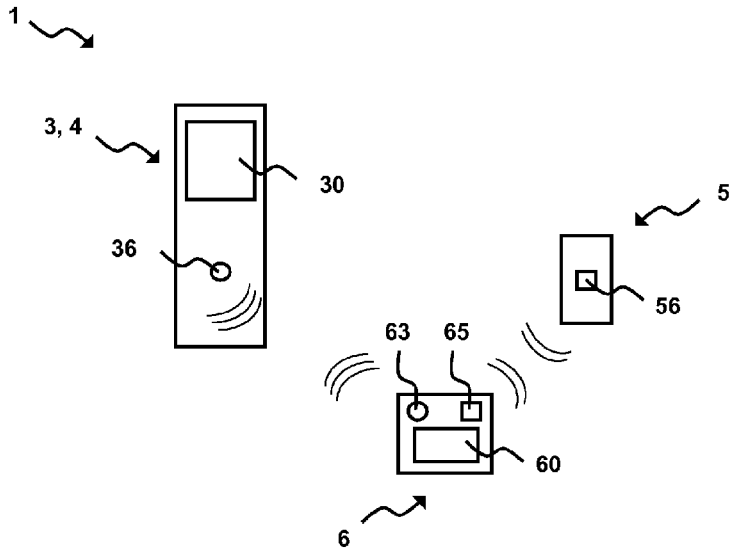
FIG. 6 shows a schematic view of a part of the lift installation with communication between a lift control and mobile apparatus according to FIGS. 4 and 5.
Figure 7:
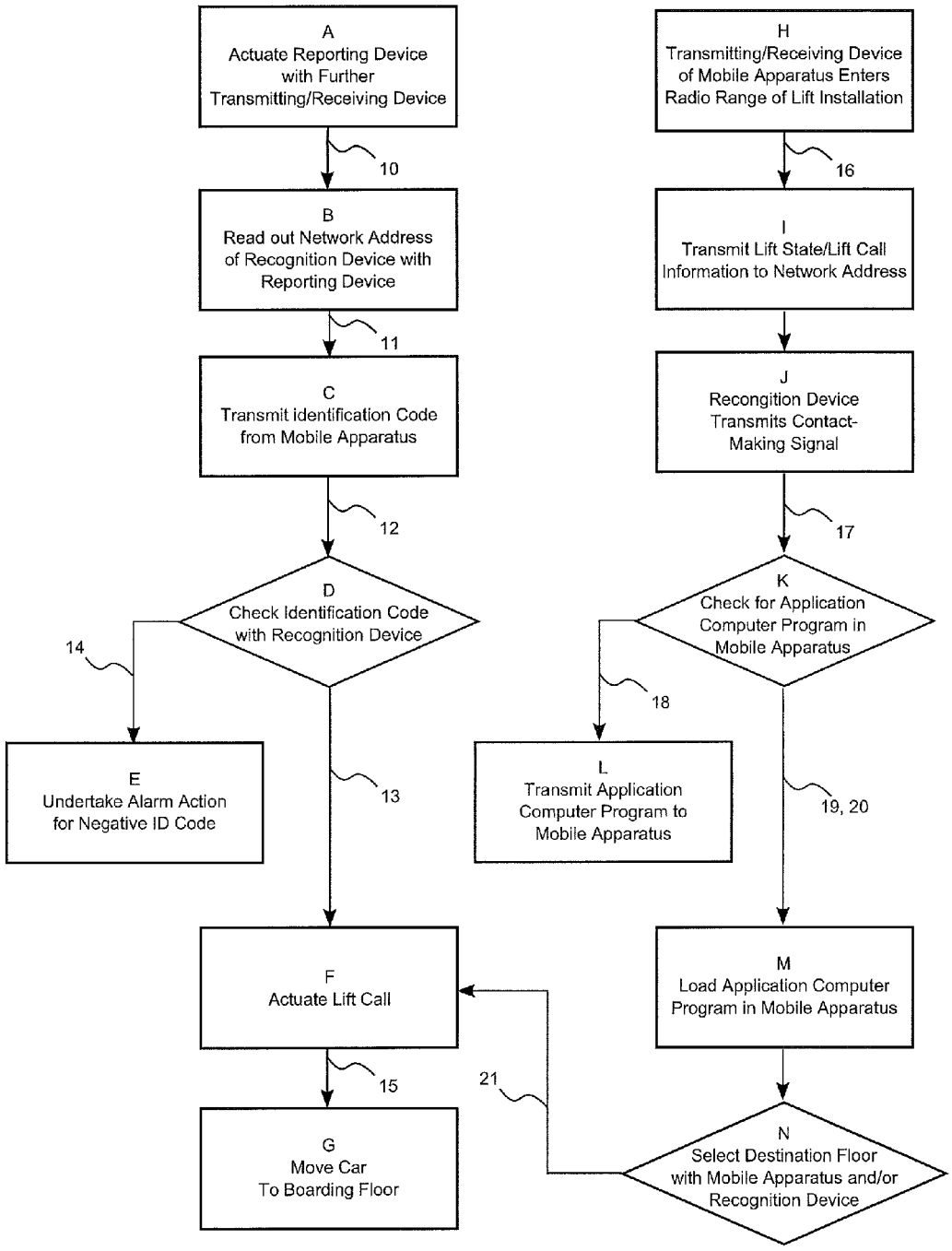
FIG. 7 shows a flow chart of a part of the method according to the invention.
Figure 8:
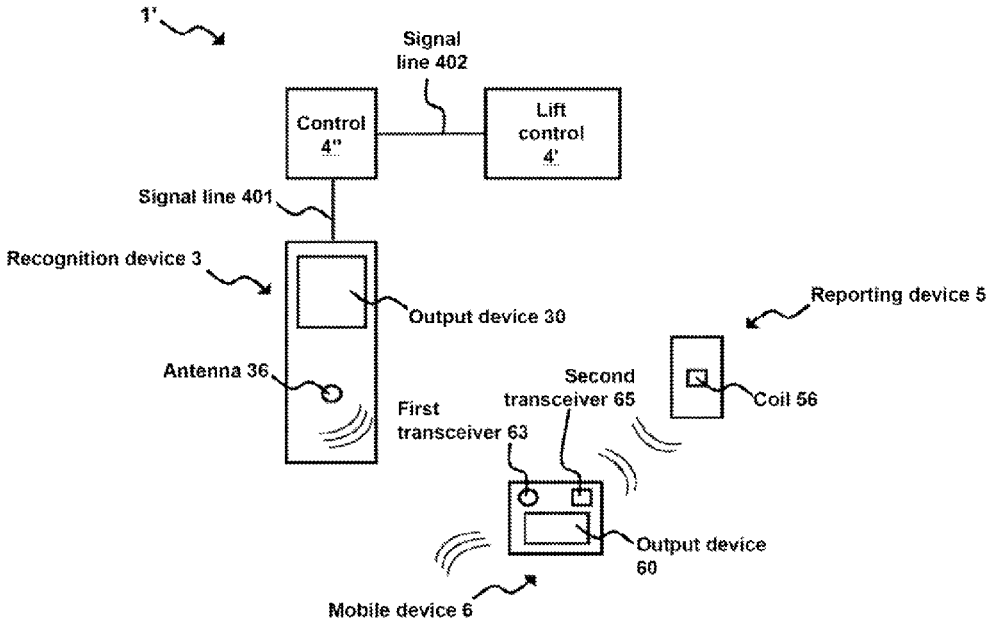
FIG. 8 shows a schematic view of a part of an exemplifying embodiment of a retrofitted lift installation of the invention.

FIGS. 1 to 6 show two exemplifying embodiments of lift installations of the invention, FIG. 7 shows a flow chart of the method according to an embodiment of the invention and FIG. 8 shows an exemplifying embodiment of a retrofitted lift installation of the invention. FIGS. 1 and 4 show a building with several floors S01, S02, . . . S06, S07, S08, . . . S18, S19, S20 and with a lift installation 1 with at least one lift car 2. The lift installation moves, in at least one lift shaft, passengers in the building, which is illustrated by upward and downward arrows. For example, passengers are moved by the lift installation 1 according to FIG. 1 in the twenty floors S01 to S20 of a building and passengers are moved by the lift installation 1 according to FIG. 4 in eight floors S01 to S08 of a building. The lift installation 1 may also include other components such as a lift drive, counterweight, drive and support elements, a door drive, shaft information detector, etc. A person of ordinary skill in the art can realise the present invention in any lift installations with substantially more lifts, such as a group with six or eight lifts; with double and triple lift cars; with several lift cars, which are arranged one above the other and movable independently of one another, per lift shaft; with lifts without counterweights, with hydraulic lifts; etc.

The lift installation 1 includes at least one lift control 4. The lift control 4 can be arranged at any desired location in the building. The lift control 4 is connected by way of signal lines with components of the lift insulation 1 such as recognition device 3, a lift drive, lift car 2, a door drive, a shaft information detector, etc. The lift control 4 includes at least one processor, at least one computer readable data memory and at least one electrical power supply. At least a portion of a control computer program is loaded from the computer readable data memory into the processor and executed. The control computer program controls, using the various elevator components, the movement of the lift car 2 by way of the lift drive and the opening and closing of the lift door by way of the door drive. The lift control 4 obtains, from the shaft information detector, data about the instantaneous position of the lift car 2 in the lift shaft. The signal lines are laid in buried form or hung in the lift shaft. The lift control 4 bidirectionally communicates with the recognition device 3 by way of a network, such as a wired network or a wireless network according to known and proven network protocols such as the Transmission Control Protocol/Internet Protocol (TCP/IP) or Internet Packet Exchange (IPX). The lift control 4 communicates at least one item of lift state information and at least one item of lift call information to the recognition device 3. For this purpose the lift control 4 and the recognition device 3 each comprise at least one network adapter.

For example, the lift installation according to FIG. 1 has on the uppermost floor S20 a lift control 4 as well as on each floor S01, S02, . . . S18, S19, S20 a recognition device 301, 302, . . . 318, 319, 320, whilst the lift installation 1 according to FIG. 4 has a recognition device 3, which is combined with the lift control 4, on the floor S02. The recognition device 3 can be a stand-alone device, with a housing, electrical power supply, processor, computer readable data memory, network adapter, antenna 63, output device 30, keyboard, etc. The recognition device 3 can, however, also be substantially or completely integrated in the lift control 4 and, for example, be a printed circuit with a processor, computer readable data memory, network adapter, antenna 36, output device 30, keyboard, etc., which is placed into the housing of the lift control 4. At least one lift door is usually arranged on each floor S01 to S20. In exemplifying embodiments according to FIGS. 2 and 3 two lift doors 200, 201 are arranged on the floor S02, wherein a recognition device 302 is arranged near a lift door 200. The recognition device 3 is, for example, mounted on a building wall or stands in isolation in a space such as the lobby in front of the lift door.

The recognition device 3 communicates using a wireless network with at least one mobile apparatus 6. For that purpose, the recognition device 3 has at least one antenna 36. The recognition device 3 includes at least one processor and at least one computer readable data memory. At least one communications computer program for controlling the transmission and reception of signals by way of the antenna 36 may be loaded from the computer readable data memory into the processor and executed. The recognition device 3 also comprises at least one output device 30. At least one application computer program for issuing at least one item of lift state information 19 and/or item of lift call information 20, may be loaded from the computer readable data memory into the processor and executed. The issued item of lift state information 19 and/or item of lift call information 20 may be communicated by the lift control 4, on the output device 30. The item of lift state information 19 and the item of lift call information 20 can be stored in the computer readable data memory of the output device 30.

The mobile apparatus 6 is carried by the passenger and is, for example, a mobile telephone and/or a computer with at least one transmitting/receiving device 63. The mobile apparatus 6 comprises at least one processor and at least one computer readable data memory and at least one electrical power supply. A communications computer program for controlling transmission and reception of signals by way of the transmitting/receiving device 63 and the wireless network may be loaded from the computer readable data memory into the processor and executed.

Known local wireless networks of up to 300 meters reception range such as Bluetooth (IEEE 802.15.1), ZigBee (IEEE 802.15.4) or WiFi (IEEE 802.11) at a frequency of, for example, 800/900 MHz or 2.46 GHz can be used for the communication of the recognition device 3 with the transmitting/receiving device 63 of the mobile apparatus 6. In the exemplifying embodiments according to FIGS. 3 and 6 this communication is illustrated by curved triple circular segments. The wireless network allows a bidirectional communication according to known and proven network protocols such as the Transmission Control Protocol/Internet Protocol (TCP/IP) or Internet Packet Exchange (IPX).

The communications computer program of the recognition device 3 can communicate with the transmitting/receiving device 63 in the radio network and transmit an application computer program as well as an item of lift state information 18 and an item of lift call information 19 to a network address of the transmitting/receiving device 63.

The application computer program received by the transmitting/receiving device 63 is stored in the computer readable data memory of the mobile apparatus 6 and can be there loaded into and executed in the processor of the mobile apparatus 6. In the same manner the item of lift state information 19 and/or the item lift call information 20, which may be received by the transmitting/receiving device 63, may be stored in the computer readable data memory of the mobile apparatus 6.

The application computer program in the mobile apparatus 6 can also be a pre-installed Web Browser such as Internet Explorer, Mozilla Firefox, Opera Mobile, Thunderhawk, etc. A Web Server such as Apache http Server, Jakarta Tomcat, etc., may be installed in the recognition device 3. The application computer program in the recognition device 3 uses the Web Server for communication between recognition device 3 and mobile apparatus 6 by way of the radio network when the mobile apparatus 3 uses the Web Browser.

The application computer program controls at least one output device 60 of the mobile apparatus 6. The output device 60 can include an acoustic device such as a loudspeaker, a microphone and/or an optical device such as a screen. The executed application computer program issues the item of lift state information 19 and/or the item of lift call information 20 on the output device 60.

At least one reporting device 5 is mounted near the lift installation 1. For example, the lift installation 1 according to FIG. 1 has on the uppermost floor S20 a reporting device 520 and on the other floors S01, S02, . . . S18, S19 several reporting devices 501, 501', 502, 502', . . . 518, 518', 519, 519', whilst the lift installation 1 according to FIG. 4 has on each floor S01, S02, . . . 506, S07, S08 several reporting devices 501, 501', 502, 502', . . . 506, 506', 507, 507', 508, 508'. As shown in the exemplifying embodiments according to FIGS. 2 and 4, a reporting device 502, 502' can be mounted near and/or on a lift door 21 or remotely from lift doors 200, 201 on a floor 502. The reporting device 5 is, for example, an RFID transponder with at least one computer readable data memory, at least one processor and at least one coil 56.

The mobile apparatus 6 includes a second transmitting/receiving device 65 for communication by way of a wireless network with the reporting device 5. The transmitting/receiving device and the second transmitting/receiving device may be implemented as separate hardware units, or may alternatively be implemented using a single unit which serves both functions. The communication between the reporting device 5 and the second transmitting/receiving device 65 can be bidirectional. At least one communications computer program for controlling the transmission and reception of the second transmitting/receiving device 65 can be loaded from the computer readable data memory of the mobile apparatus 6 into the processor and executed. second The communication between the second transmitting/receiving device 65 and the reporting device 5 may be carried out in a near field radio network of up to one meter reception range at radio frequencies of, for example, 125 KHz, 13.56 MHz, 2.46 GHz, etc. For this purpose, FIG. 7 shows a flow chart of a part of the method of operating a lift installation 1.

In method step A the mobile apparatus 6 is brought into the reception range of the reporting device 5. The reporting device 5 receives, by way of the coil 56, inductive energy from an electromagnetic field of the second transmitting/receiving device 65 and is thus activated in terms of energy by way of least one activation signal 10. The activation in terms of energy is carried out automatically as soon as the second transmitting/receiving device 65 is located in the reception range of the coil 56 of the reporting device 5, which may be in the range of a few centimeters up to one meter.

As soon as the reporting device 5 is activated in terms of energy, the processor of the reporting device 5 reads out, in method step B, a network address 11, which is filed in a computer readable data memory, of the recognition device 3, which network address 11 is transmitted by way of the coil 56 to the second transmitting/receiving device 65. The activation in terms of energy of the reporting device 5 and the transmission of the network address 11 of the recognition device 3 to the second transmitting/receiving device 65 is carried out contactlessly. The second transmitting/receiving device 65 receives the transmitted network address 11 of the recognition device 3.

In method step C the mobile apparatus 6 uses the received network address 11 of the recognition device 3 and transmits by the transmitting/receiving device 63 an identification code 12 to the received network address 11 of the recognition device 3. The recognition device 3 receives the identification code 12.

In method step D the received identification code 12 is recognised by the recognition device 3. For this purpose at least one recognition computer program for controlling checking of the identification code 12 by the recognition device is loaded from the computer readable data memory into the processor. In addition, passenger data are loaded from the computer readable data memory into the processor and compared with the received identification code 12. A passenger recognition signal 13 is communicated to the lift control for a positive checked identification code 12. An alarm signal 14 is transmitted for a negative checked identification code 12. Thereupon, an alarm action is undertaken in method step E. The alarm action may include, for example, a notification by the alarm signal 14 of a security service and/or the police.

In method step F a lift call 15 is actuated, or several possible destination floors are determined, by the lift control 4 for a received passenger recognition signal 13. For example, the lift call 15 is at least one destination call, which includes call data with respect to a boarding floor and a destination floor of a passenger. However, it is also possible for the lift call 15 to be a combination of at least one floor call and at least one car call, wherein the floor call includes data with respect to a boarding floor and the car call includes data with respect to a destination floor.

The lift control 4 controls, by way of the control computer program, the movement of the lift car 2 by way of the lift drive and the opening and closing of the lift door by way of the door drive. Thus, in method step G the lift car 2 is moved by the lift drive to the boarding floor, the lift door is opened by the door drive and the passenger can enter the lift car 2. The door drive thereafter closes the lift door and the lift car 1 is moved by the lift drive to the destination floor, where the door drive opens the lift door and the passenger leaves the lift car 2.

Independently of all the previous method steps B to G, in method step H the transmitting/receiving device 63 is brought into the reception range of the wireless network of the lift installation 4, for example in that a passenger carries the mobile apparatus 6 into the building of the lift installation 4. The method steps A and H can thus take place with a small offset in time. The transmitting/receiving device 63 reports in the wireless network using an interrogation signal 16.

In method step I a network address of the transmitting/receiving device 63 is determined by the co-ordination computer program or a network address is allocated to the transmitting/receiving device 63. The network address of the transmitting/receiving device 63 is recorded in the connections table and is available to the recognition device 3.

In method step J the recognition device 3 transmits at least one contact-making signal 17 to the network address of the transmitting/receiving device 63. By the contact-making signal 17 the mobile apparatus 6 is interrogated as to whether an application computer program is stored in its computer readable data memory. The transmitting/receiving device 63 receives the contact-making signal and checks in method step K whether an application computer program is stored in the computer readable data memory of the mobile apparatus 6. If such a program is not stored, the transmitting/receiving device 63 transmits a negative signal 18, whereupon in method step L the recognition device 3 transmits application computer program to the transmitting/receiving device 63, which stores the received application computer program in the computer readable data memory of the mobile apparatus 6.

If an application computer program is stored in the computer readable data memory of the mobile apparatus 6 this program is loaded into the processor of the mobile apparatus 6 and executed in method step M. The application computer program controls the output device 60 of the mobile apparatus 6. The recognition device 3 transmits lift state information 19 and/or lift call information 20 to the transmitting/receiving device 63. The transmitting/receiving device 63 receives the item of lift state information 19 and/or the item of lift call information 20. The application computer program issues the received item of lift state information 19 and/or item of lift call information 20 on the output device 60. The same item of lift state information 19 and the same item of lift call information 20 can be issued by the recognition device 3 also on the output device 30 of the recognition device 3.

The passenger thus obtains an item of lift state information 19 and/or an item of lift call information 20. The item of lift state information 19 indicates to the passenger the operating state in which the lift installation 1 is disposed, i.e. to which degree the lift installation 1 is available. A positive item of lift state information 19 reads, for example: "100% availability" and a negative item of lift state information 18 reads, for example: "70% availability, Lift B in maintenance until 1430 hours". The item of lift call information 20 issues to the passenger a call acknowledgement and/or an item of travel information. The item of travel information informs the passenger which lift and/or which lift car 2 is provided in order to move the passenger. In addition, the item of travel information guides the passenger from his or her present position to the lift car 2. For example, an item of lift call information 20 reads: "Please go 10 meters to the left and take Lift C". The item of lift call information 20 further indicates the boarding floor and the destination floor. In addition, the item of the lift call information 20 indicates to the passenger the anticipated arrival time of the lift car 2 at the boarding floor and/or the arrival time of the lift car 2 at the destination floor. For example, an item of lift call information 20 reads: "The estimated arrival time of the lift car takes place in 12 seconds". The item of lift state information 18 and the item of lift call information 20 are constantly updated. The item of lift state information 19 and the item of lift call information 20 can be issued optically and/or acoustically as lights flashing for a greater or lesser length of time, tone sequences, signal sequences, etc.

In method step N the passenger newly selects the destination floor or selects a destination floor from several possible destination floors. For a change of the destination floor, the passenger selects the destination floor, which is issued on the output device 30, 60 as an item of lift call information 20, by the mobile apparatus 6 and/or by the recognition device 3 and newly selects for that purpose a destination floor. For selection of a destination floor, several possible destination floors determined by the lift control are issued to the passenger on the output device 30, 60 as item of lift call information 20. The passenger selects a floor from the possible destination floors by the mobile apparatus 6 and/or by the recognition device 3. The destination floor newly selected by the passenger or the destination floor selected by the passenger is communicated to the lift control 4 as passenger confirmation signal 21. The lift control 4 receives the passenger confirmation signal 21 and the control computer program corrects the lift call 15. The control computer program controls the movement of the lift car 2 to the destination floor newly selected by the passenger or to the destination floor selected by the passenger.

For example, the mobile apparatus 6 and/or the recognition device 3 may comprise a keyboard by way of which the passenger can manually input the destination floor. The user inputs the destination floor "18" by hand as numeral sequence "1" and "8" on the keyboard. The keyboard can also be a touch-sensitive button screen. For example, the user can move, by keyboard actuation, a cursor over possible destination call indications and similarly stop, by keyboard actuation, the cursor over a destination call indication and thus actuate a corresponding changed lift call, which is communicated to the lift control 4 as passenger confirmation signal 21.

FIG. 8 shows a retrofitted lift installation 1' of the invention. The existing lift installation 1' includes at least one lift car 2 and at least one existing lift control 4'. The existing lift control 4' is connected by way of signal lines with the existing components of the existing lift installation 1' such as lift drive, lift car 2, door drive, shaft information, etc. The existing lift control 4' includes a processor and a computer readable data memory and an electrical power supply. A control computer program is loaded from the computer readable data memory into the processor and executed. The control computer program controls the movement of the lift car 2 by way of the lift drive and the opening and closing of the lift door by way of the door drive. The existing lift control 4' obtains, from the shaft information, data about the instantaneous position of the lift car 2 in the lift shaft. The signal lines are laid buried or hung in the lift shaft.

In order to retrofit an existing lift installation 1' to form a lift installation 1 according to the invention in accordance with FIGS. 1 to 6, at least one recognition device 3 is, in one step, installed in operative connection with the existing lift control 4'. In a further step at least one reporting device 5 is installed near the lift installation 1'. Both the recognition device 3 and the reporting device 5 have been previously described so that reference is made to these descriptions. In particular, the recognition device 3 communicates by way of a wireless network with the transmitting/receiving device 63 of the mobile apparatus 6 and the reporting device 5 communicates by way of a wireless network with the second transmitter/receiving device 65 of the mobile apparatus 6.

For retrofitting of the existing lift installation 1' to form a lift installation 1 at least one control 4" is installed in a further step. The control 4" realises the operative connection of the recognition device 3 with the existing lift control 4'. The control 4" is connected with the recognition device 3 by way of a signal line 401 and it is connected by way of at least one further signal line 402 with the existing lift control 4'. The control 4" can be a stand-alone apparatus with an own housing, own electrical power supply, own processor, own computer readable data memory, own network adapter, etc. The control 4" can, however, also be substantially or completely integrated in the recognition device 3 and, for example, be included as a printed circuit with a processor, computer readable data memory, network adapter, etc., which is placed into the housing of the recognition device 3.

The signal lines 401, 402 are, for example, a data bus of a wired network according to known and proven network protocols. However, particularly in the case of older lift installations 1' it is also possible that the signal lines 401, 402 are analog signal lines which are connected to the existing lift control 4' by inputs and outputs with the floor terminals or lift car terminals.

Due to the fact the control 4" is placed between the recognition device and the existing lift control 4' the recognition device 3 or the mobile apparatus 6 communicates directly via the control 4" with the existing lift control 4'. Thus, in method step D at least one passenger recognition signal 13 is communicated to the control 4" by the recognition device 3 for a positive checked identification code 12. At least one lift call 15 is communicated to the existing lift control 4' by the control 4" for a received passenger recognition signal 13.

In this mode and manner the control 4" can, in the method step F, actuate at least one destination call as lift call 15 or the control 4" can actuate at least one floor call and at least one car call as lift call 15. For that purpose the control 4" simulates a lift call 15 in that a lift call signal is applied to the corresponding inputs and outputs of the existing lift control 4" without a button of a floor terminal or lift car terminal being actuated. For a floor call from a boarding floor the control 4" generates a lift call signal at the input of the existing lift control 4' to the floor terminal of the boarding floor. For a car call from the lift car 2 the control 4" generates a lift call signal to the destination floor at the input of the existing lift control 4' to the lift car terminal. For a destination call from a boarding floor to a destination floor the control 4" generates a lift call signal at the input of the existing lift control 4' to the floor terminal of the boarding floor and a lift call signal to the destination floor at the input of the existing lift control 4' to the lift car terminal.

The control 4" bidirectionally communicates with the recognition device 3 and the existing lift control 4' in a network, such as a wired network or a wireless network according to known and proven network protocols. With knowledge of the present invention it is obviously also possible to replace the previous lift control 4' by a new lift control 4 according to the form of embodiment of FIGS. 1 to 6, which new lift control 4 fulfils the functions of the former lift control 4' and those of the control 4".

In method step I lift state information 19 and/or lift call information 20 are transmitted to the network address of the transmitting/receiving device 63 by the recognition device 3. In method step M lift state information 19 and/or lift call information are issued at the output device 30 of the recognition device 3 or the item of lift state information 19 and/or the item of lift call information 20 are received by the transmitting/receiving device 63 and the received item of lift state information 19 and/or item of lift call information 20 are issued on the output device 60 of the mobile apparatus 6.

In method step N the passenger newly selects at least one destination floor of the issued item of lift call information 20 by the mobile apparatus 6 and/or by the recognition device 3. A new selected destination floor is transmitted to the control 4" by the recognition device 3 and/or by the transmitting/receiving device 63 as passenger confirmation signal 21. Correspondingly, the passenger selects one of several possible destination floors of the issued item of lift call information 20 by the mobile apparatus 6 and/or by the recognition device 3. A selected destination floor is communicated to the control 4" by the recognition device 3 and/or by the transmitting/receiving device 63 as passenger confirmation signal 21. The passenger confirmation signal 21 is received by the control 4". The lift call 15 is corrected by the control 4" in accordance with the received passenger confirmation signal 21 and at least one corrected lift call 15 is communicated to the existing lift control 4' by the control 4".

While there have been shown and described particular features of the invention as applied to preferred embodiments thereof, it will be understood that various omissions, substitutions, and changes in the form and details of the devices illustrated, and in their operation, may be made by those skilled in the art without departing from the spirit and scope of the invention.

The invention claimed is:

1. A control system for a lift installation, the control system comprising:

at least one lift control, the at least one lift control comprising at least one recognition device that wirelessly communicates with a first transmitting device and a first receiving device of a mobile device and receives at least one identification code from the mobile device; and a reporting device mounted near the lift installation that wirelessly communicates at least one network address of the recognition device to a second transmitting device and a second receiving device of the mobile device.

2. The control system of claim 1 wherein the reporting device is activated by the second transmitting device.

3. The control system of claim 2, wherein the recognition device receives, at the at least one network address, at least one identification code transmitted by the first transmitting device of the mobile device, and verifies the at least one identification code.

4. The control system of claim 3, wherein the recognition device communicates at least one passenger recognition signal to the lift control for a positive checked identification code, and communicate at least one alarm signal for a negative checked identification code.

5. The control system of claim 4, wherein the lift control actuates at least one lift call in response to receiving the passenger recognition signal.

6. The control system of claim 5 wherein the recognition device issues at least one item of lift state information or lift call information on at least one output device of the recognition device.

7. The control system of claim 5 wherein the recognition device issues at least one item of lift state information or lift call information to a network address of the first receiving device of the mobile apparatus.

8. The control system of claim 6 wherein the lift call information includes at least one of: a call acknowledgment, travel information, arrival time of a lift car at a boarding floor, and arrival time of a lift car at a destination floor.

9. The control system of claim 7 wherein the lift call information includes at least one of: a call acknowledgment, travel information, arrival time of a lift car at a boarding floor, and arrival time of a lift car at a destination floor.

10. The control system of claim 6 wherein the lift call information includes several possible destination floors, and wherein the lift control receives a selected destination floor from the recognition device as a passenger confirmation signal.

11. The control system of claim 7 wherein the lift call information includes several possible destination floors, and wherein the lift control receives a selected destination floor from the first transmitting device of the mobile apparatus as a passenger confirmation signal.

12. The control system of claim 1 wherein the reporting device includes an RFID transponder.

13. A method of operating a lift installation with at least one lift car, at least one lift control and at least one mobile apparatus, the method comprising:

receiving at least one activation signal at a reporting device near the lift installation from a first transmitting device of a mobile apparatus;

activating the reporting device in response to the received activation signal; and transmitting at least one network address of a recognition device of the at least one lift control of the lift installation from the activated reporting device to a first receiving device of the mobile apparatus.

14. The method of claim 13 further comprising receiving at least one identification code from a second transmitting device of the mobile apparatus at the network address of the recognition device of the lift control.

15. The method of claim 14 further comprising receiving, at the network address, at least one identification code transmitted by the second transmitting device of the mobile device, and verifying the at least one identification code.

16. The method of claim 15, further comprising communicating at least one passenger recognition signal from the recognition device to the lift control for a positive checked identification code, and communicating at least one alarm signal from the recognition device to the lift control for a negative checked identification code.

17. The method of claim 16, further comprising actuating at least one lift call in response to receiving the passenger recognition signal.

18. The method of claim 17 further comprising issuing at least one item of lift state information or lift call information on at least one output device of the recognition device.

19. The method of claim 17 further comprising issuing at least one item of lift state information or lift call information to a network address of a second receiving device of the mobile apparatus.

20. The method of claim 18 wherein the lift call information includes: a call acknowledgment, travel information, arrival time of a lift car at a boarding floor, or arrival time of a lift car at a destination floor.

21. The method of claim 19 wherein the lift call information includes: a call acknowledgment, travel information, arrival time of a lift car at a boarding floor, or arrival time of a lift car at a destination floor.

22. The method of claim 18 wherein the lift call information includes several possible destination floors, and further comprising receiving a selected destination floor from the recognition device as a passenger confirmation signal.

23. The method of claim 19 wherein the lift call information includes several possible destination floors, and the method further comprises receiving a selected destination floor from the second transmitting device of the mobile apparatus as a passenger confirmation signal.

24. A system for operating a lift installation with at least one lift car and at least one lift control, the system comprising a programmed processor and a memory for storing instructions to be executed by the processor to cause the processor to perform the following functions:

receive at least one activation signal at a reporting device near the lift installation from a transmitting device of a mobile apparatus;

activate the reporting device in response to the received activation signal; and transmit at least one network address of a recognition device of the at least one lift control of the lift installation from the activated reporting device to a receiving device of the mobile apparatus.

25. A non-transitory computer readable memory programmed with instructions which when executed by a processor cause the processor to perform the following functions:

receive at least one activation signal at a reporting device near a lift installation from a transmitting device of a mobile apparatus;

activate the reporting device in response to the received activation signal; and transmit at least one network address of a recognition device of a lift control of the lift installation from the activated reporting device to a receiving device of the mobile apparatus.

26. A system comprising:

a lift installation recognition device, the recognition device comprising a recognition device transceiver that wirelessly communicates with a mobile device using a first wireless communication type; and a lift installation reporting device, the reporting device comprising a reporting device transceiver that wirelessly communicates a network address of the lift installation recognition device to the mobile device using a second wireless communication type.

27. The system of claim 26, the first wireless communication type being Bluetooth, ZigBee or WiFi.

28. The system of claim 26, the second wireless communication type being a near field radio network.

29. The control system of claim 3, wherein in response to a positive checked identification code, the lift control causes a lift car to be dispatched to a corresponding boarding floor.

30. The control system of claim 11, wherein in response to receiving the selected destination floor, the lift control causes an elevator car to be dispatched to the destination floor after being dispatched to a corresponding boarding floor.

31. The control system of claim 1, wherein the reporting device receives the network address from a memory of the recognition device.

32. The method of claim 15, further comprising in response to a positive checked identification code, causing a lift car to be dispatched to a corresponding boarding floor.

33. The method of claim 22, wherein in response to receiving the selected destination floor, further causing an elevator car to be dispatched to the destination floor after being dispatched to a corresponding boarding floor.

34. The method of claim 13, further comprising receiving the network address from a memory of the recognition device.

* * * * *